US005967249A

United States Patent [19]

Butcher

[11] Patent Number: 5,967,249

[45] Date of Patent: Oct. 19, 1999

[54] SUPERABRASIVE CUTTERS WITH STRUCTURE ALIGNED TO LOADING AND METHOD OF DRILLING

[75] Inventor: Trent N. Butcher, Midvale, Utah

[73] Assignee: Baker Hughes Incorporated, Houston, Tex.

[21] Appl. No.: 08/792,066

[22] Filed: Feb. 3, 1997

[51] Int. Cl.[6] ..... E21B 10/46

[52] U.S. Cl. ..... 175/428; 175/432

[58] Field of Search ..... 175/428, 432

[56] References Cited

U.S. PATENT DOCUMENTS

| | | |
|---|---|---|
| 592,188 | 2/1897 | Smith et al. . |
| 3,902,864 | 9/1975 | Nix et al. . |
| 4,109,737 | 8/1978 | Bovenkerk . |
| 4,452,325 | 6/1984 | Radd et al. . |
| 4,478,298 | 10/1984 | Hake et al. . |
| 4,705,123 | 11/1987 | Dennis . |
| 4,726,718 | 2/1988 | Meskin et al. . |
| 4,764,434 | 8/1988 | Aronsson et al. . |
| 4,784,023 | 11/1988 | Dennis . |
| 5,007,207 | 4/1991 | Phaal . |
| 5,011,515 | 4/1991 | Frushour . |
| 5,025,874 | 6/1991 | Barr et al. . |
| 5,027,912 | 7/1991 | Juergens . |
| 5,028,177 | 7/1991 | Meskin et al. . |
| 5,096,465 | 3/1992 | Chen et al. . |
| 5,120,327 | 6/1992 | Dennis . |
| 5,159,857 | 11/1992 | Jurewicz . |
| 5,173,090 | 12/1992 | Scott et al. . |
| 5,199,832 | 4/1993 | Meskin et al. . |
| 5,205,684 | 4/1993 | Meskin et al. . |
| 5,217,081 | 6/1993 | Waldenstrom et al. . |
| 5,238,074 | 8/1993 | Tibbitts et al. . |
| 5,248,006 | 9/1993 | Scott et al. . |
| 5,264,283 | 11/1993 | Waldenstrom et al. . |
| 5,273,125 | 12/1993 | Jurewicz . |
| 5,301,762 | 4/1994 | Besson . |
| 5,335,738 | 8/1994 | Waldenstrom et al. . |
| 5,351,772 | 10/1994 | Smith . |
| 5,355,969 | 10/1994 | Hardy et al. . |
| 5,370,717 | 12/1994 | Lloyd et al. . |
| 5,377,773 | 1/1995 | Tibbitts . |
| 5,379,853 | 1/1995 | Lockwood et al. . |
| 5,379,854 | 1/1995 | Dennis . |
| 5,421,425 | 6/1995 | Griffin . |
| 5,435,403 | 7/1995 | Tibbitts . |
| 5,437,343 | 8/1995 | Cooley et al. . |
| 5,460,233 | 10/1995 | Meany et al. . |
| 5,499,688 | 3/1996 | Dennis . |
| 5,590,729 | 1/1997 | Cooley et al. . |
| 5,592,995 | 1/1997 | Scott et al. . |
| 5,605,198 | 2/1997 | Tibbitts et al. . |

FOREIGN PATENT DOCUMENTS

| | | |
|---|---|---|
| 0246789 | 11/1987 | European Pat. Off. . |
| 0322214B1 | 6/1992 | European Pat. Off. . |
| 2044146 | 8/1979 | United Kingdom . |
| 2212190 | 7/1989 | United Kingdom . |
| 2251880 | 7/1992 | United Kingdom . |
| 2299110 | 9/1996 | United Kingdom . |

OTHER PUBLICATIONS

Search Report under Section 17, App. No. GB 9802051.4, Jul. 7, 1998.

Republic of South Africa Provisional entitled "Composite Abrasive Compact" for De Beers Industrial Diamond Division Limited, Dec. 23, 1992.

*Primary Examiner*—David J. Bagnell
*Attorney, Agent, or Firm*—Trask, Britt & Rossa

[57] ABSTRACT

A cutter for use on a rotary-type drag bit for earth boring is provided comprising a substantially rectangular diamond table attached to a substrate. At least one elongated support structure made of polycrystalline diamond is contained in the cutting substrate and extends from the cutting edge of the diamond table and into the substrate. The support structure is generally arranged in line with a predicted drilling force vector that will be applied to the cutting element during drilling. The support structure, in addition to or in lieu of providing support for the cutting element, may also serve to enhance heat transfer away from the cutting face and cutting edge of the superhard table.

47 Claims, 7 Drawing Sheets

Fig. 9C (SECTION I-I)

Fig. 9A (SECTION I-I)

Fig. 9B (SECTION I-I)

SUPERABRASIVE CUTTERS WITH STRUCTURE ALIGNED TO LOADING AND METHOD OF DRILLING

FIELD OF THE INVENTION

The present invention relates generally to cutting elements or cutters for drill bits used in subterranean drilling and, more specifically, to cutting elements including cutting surfaces of superhard or superabrasive material, the cutting elements being structured to provide enhanced load-carrying capabilities and enhanced heat transfer from the cutting surface through the body of the cutting element.

STATE OF THE ART

Rotary drag type drill bits are generally comprised of a bit body having a shank for connection to a drill string and an inner channel for supplying drilling fluid to the face of the bit. The bit body typically carries a plurality of cutting elements, each cutting element being mounted directly on the bit body or on a carrier, such as a stud or post, that is received in a socket in the bit body.

Polycrystalline diamond compact cutting elements, commonly known as PDC's, have been commercially available for over 20 years. PDC's may be self-supporting or, more commonly, may comprise a substantially planar diamond table bonded during formation to a supporting substrate typically comprised of tungsten carbide (WC). A diamond table/substrate cutting element structure is formed by stacking into a cell layers of fine diamond crystals (100 microns or less) and metal catalyst powder, alternating with wafer-like metal substrates of cemented tungsten carbide or other suitable materials. In some cases, the catalyst material may be incorporated in the substrate in addition to or in lieu of using a powder catalyst intermixed with the diamond crystals. A loaded receptacle is subsequently placed in an ultra-high temperature (typically 1450–1600° C.), ultrahigh pressure (typically 50–70 kilobar) diamond press, wherein the diamond crystals, stimulated by the catalytic effect of the metal powder, bond to each other and to the substrate material. The spaces in the diamond table between the diamond-to-diamond bonds are filled with residual metal catalyst. A so-called thermally stable PDC product (commonly-termed as TSP) may be formed by leaching out the metal present in the diamond table after fabrication. Alternatively, silicon, which possesses a coefficient of thermal expansion similar to that of diamond, may be used to bond diamond particles to produce an Si-bonded TSP. TSP's are capable of enduring higher temperatures (on the order of 1200° C.) without degradation in comparison to normal PDC's, which experience thermal degradation upon exposure to temperatures of about 750–800° C.

While PDC and TSP cutting elements employed in rotary drag bits for earth boring have achieved major advances in obtainable rate of penetration while drilling and in greatly expanding the types of formations suitable for drilling with diamond bits at economically viable cost, the diamond table/substrate configurations of state of the art planar cutting elements leave something to be desired.

First, bending attributable to the loading of the cutting element by the formation may cause fracture or even delamination of the diamond table from the substrate. It is believed that such degradation of the cutting element is due at least in part to lack of sufficient stiffness of the cutting element so that, when encountering the formation, the diamond table actually flexes due to lack of sufficient rigidity or stiffness. As diamond has an extremely low strain to failure in tension (diamond cannot tolerate large values of absolute strain), only a small amount of flex in the diamond table can initiate fracture. In addition, fracture may also be initiated in the highly stressed carbide substrate when cutting loads are applied to the cutting element. The carbide is stressed in tension during cooling after the previously-described fabrication process, due to the difference in coefficients of thermal expansion between the diamond and the substrate material.

A second limitation of PDC's is due to excessive buildup of heat due to frictional forces generated during the cutting process. While the superhard material of the cutting element table has an extremely high thermal conductivity (on the order of 400 to over 600 watts/meter Kelvin) and the substrate has a relatively high thermal conductivity (on the order of 100 watts/meter Kelvin), the bit body, typically steel or WC matrix, has a far lower thermal conductivity (on the order of 30 watts/meter Kelvin). As the cutting element wears and the point of contact with the formation becomes an ever-wider wear flat, the cutting element is subjected to higher cutting energies, limiting and actually reducing the potential rate of heat transfer through the cutting element. The heat buildup under certain drilling conditions may cause overheating of the cutting element and consequent accelerated wear of the diamond table and supporting substrate. In "dull" or used bits, such excessive heating is often manifested in the WC substrate behind the diamond table by the phenomenon of "heat checking", which comprises vertically running fractures in a checkerboard pattern.

It has been proposed to enhance the stiffness of superhard cutting elements by providing the superhard table with a linearly-extending portion of enhanced thickness. Such a configuration provides additional stiffness for the cutting structure, and also beneficially increases compressive stresses in the superhard material table while lowering tensile stresses in the supporting substrate. A number of variations of this approach are described in U.S. patent application Ser. No. 08/164,481 to Gordon A. Tibbitts, now U.S. Pat. No. 5,435,403, co-pending U.S. patent application Ser. No. 08/353,453 to Gordon A. Tibbitts and Craig H. Cooley now U.S. Pat. No. 5,590,729, a continuation in part of U.S. Pat. No. 5,435,403, and co-pending U.S. patent application Ser. No. 08/430,444 to Gordon A. Tibbitts and Evan C. Turner, now U.S. Pat. No. 5,605,198, and its co-pending U.S. divisional application Ser. No. 08/742,858, now U.S. Pat. No. 5,787,022 all assigned to the assignee of the present invention and incorporated herein by this reference.

It has been proposed to promote heat transfer from a PDC element to the underlying bit structure in U.S. Pat. No. 4,478,297, issued to Robert P. Radtke and assigned on its face to Strata Bit Corporation. The Radtke patent proposed to use a hollow cylindrical stud with a recess extending into about the middle of the stud from the bottom thereof, the recess being filled with a soft, heat-conducting metal to facilitate heat transfer from the PDC at the upper or outer end of the stud. The aforementioned application Ser. No. 08/353,453 also discloses cutting structures with enhanced heat transfer characteristics.

Prior art approaches to load-carrying capacity of cutters tend to be somewhat general in design approach to a category of forces or loads, and thus may require more relatively expensive superabrasive material than is actually required to address the most critical magnitudes and directions of loading. Similarly, while the concept of enhanced heat transfer in superabrasive cutting elements is well known, the solutions are somewhat generalized rather than optimized for specific applications.

Therefore, despite the above-referenced developments in the art, it is believed by the inventor that both cutting element load capacity and heat transfer capabilities can be significantly enhanced via the invention described and claimed herein.

SUMMARY OF THE INVENTION

In accordance with the present invention, a cutting element is provided for use on a rotary drag bit for earth boring operations. According to the invention, a cutting element is comprised of a substrate made of a suitable material, such as cemented tungsten carbide. The substrate may be attached to a post, stud, or other carrier element which is attached by means known in the art to the face of the rotary drag bit. The carrier element orients the cutting element in an orientation relative to the instantaneous direction of linear displacement of the cutter resulting from rotation of the rotary drag bit. Alternatively, the cutting element may be attached directly to the bit face, such as by insertion in a socket or pocket formed therein, which provides the required orientation.

A diamond table may be attached to, and preferably formed on, the substrate by means known in the art. The diamond table typically comprises a polycrystalline diamond compact (PDC), or other superabrasive material, and defines the cutting face of the cutting element. This cutting face is of a generally planar configuration, but may be curved or otherwise non-linear, but essentially two-dimensional. As used herein, the term "planar" does not require or necessarily indicate flatness, but merely extension primarily in two dimensions to present a cutting surface which may be concave, convex, ridged or otherwise exhibit a surface topography which is not necessarily "flat." In addition, the diamond table may include a chamfer along its cutting edge to prevent premature chipping and spalling of the cutting edge, or the cutting edge may be rounded as also known in the art. Likewise, the side surface of the substrate may be tapered, flaring out behind the diamond table to buttress the edges of the diamond table and provide support therefor.

Because forces on the cutting elements during drilling tend to be applied within a relatively narrow range of angles relative to the cutting face of the cutting element, one or more substantially internal support structures extending from the diamond table or cutting face of the cutting element are aligned with the angles of expecting forces so that the force is translated through the support structures and into or even through the body of the cutting element, to a carrier element, and/or to the face (and into the body) of the drill bit. Preferably, the support structures are made of polycrystalline diamond (or other superabrasive material) and are substantially, if not entirely, contained within the substrate. The support structures may be more narrow in cross-section nearest the cutting face of the cutting element and rearwardly expand in cross-section or may have a larger cross-section nearest the cutting face. It is also possible to align the support structure or structures at an angle relative to the expected force angle or range of force angles so that the applied force is translated through the support structure to a desired location remote from the cutting face. Moreover, the support structures may be of circular or other geometrical, transverse cross-sections.

The support structures may extend from or be an integral part of the diamond table, or may extend from the cutting face of a cutting element that is not provided with a "diamond table" in the traditional sense. With the cutting edge of the diamond table being chamfered or radiused, the chamfer or radius can provide a base for the end of the support structure, thus reducing the risk of the cutting edge being damaged during the initial part of the drilling operation. Further, the support structures may extend into the substrate any distance less than the full length of the substrate or may actually have their distal ends exposed at the back of the substrate.

These support structures according to the invention provide several enhancements to the structural integrity of the cutting element. First, they provide structural strength to the cutting element by stiffening and strengthening the diamond table in precisely the region that is contacted by the rock formation and that experiences the highest stresses by translating forces applied to the cutting element through the cutting element to the bit body. Additionally, they provide a path of low thermal resistance that will allow heat that is generated at the cutting face during the cutting process to be more efficiently carried away from the cutting edge. If the structures extend the full length of the substrate, they will direct the heat directly into the drill bit body or supporting carrier element. As a result, the cutting element, and specifically the diamond or other superabrasive table, will experience lower strain due to cutting loads on the cutting element, stay cooler, and thus have a longer life than conventional cutting structures. Particularly destructive bending stresses will be markedly reduced.

In a preferred embodiment, the support structures comprise struts contained in a semicircular cutting element comprising approximately half of a cylindrical cutting element. Once half of the cutting face of the cutting element has been worn away, the cutting element is normally replaced. Thus, it is possible to fabricate two cutting elements according to the invention from a single, substantially cylindrical part. That is, by placing the struts in both halves of a cutting element and then dividing the cutting element longitudinally into two halves, one cylindrical part could produce two semi-cylindrical cutting elements. If desired, a metal or other superhard substrate shaped and sized to match the cutting element half could then be bonded to the cutting element half to make a complete, cylindrical cutter. Otherwise, the semicircular cutting element could be attached to a carrier element of any suitable configuration, or directly to the drill bit.

These, and other advantages of the present invention, will become apparent from the following detailed description, the accompanying drawings, and the appended claims.

BRIEF DESCRIPTION OF THE DRAWINGS

FIG. 9A, 9B and 9C are sectional views of three embodiments of the support structure illustrated in FIG. 9;

DETAILED DESCRIPTION OF THE PREFERRED EMBODIMENTS

Figure 1:
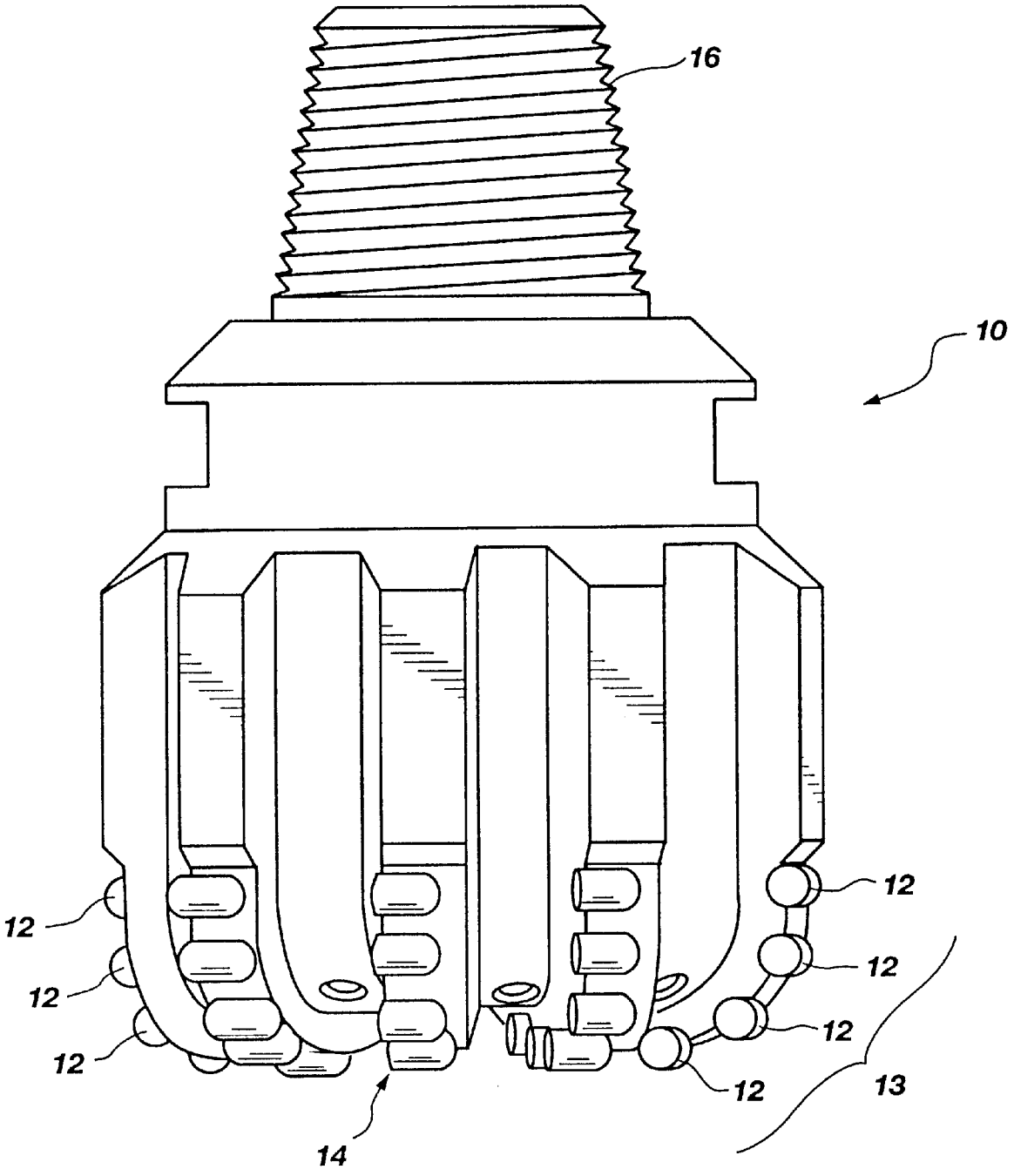
FIG. 1 is a side elevation of a rotary drag bit carrying cutters of the present invention.

The invention is illustrated in the drawings with reference to an exemplary rotary earth boring bit 10. Referring to FIG. 1, drag-type rotary bit 10 is shown, although the present invention possesses equal utility in the context of coring bits (not shown) or other rotary drag-type bits known in the art. The bit 10 may be attached to a drill string (not shown) by external threads 16 to provide rotation of the bit 10. A plurality of cutting elements 12 of the present invention is secured to the bit crown 14 of the drill bit 10 for cutting rock as the drill bit 10 is rotated into a subterranean formation under weight on bit (WOB), as known in the art.

Figure 2A:
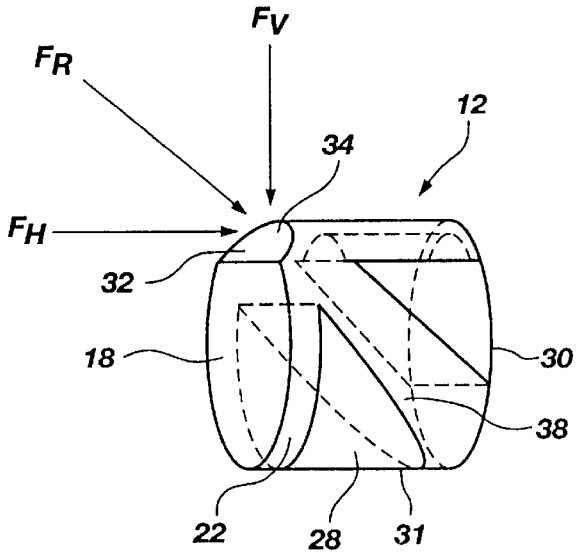
FIG. 2A is a perspective view of a first embodiment of a cutter in accordance with the present invention.

Referring now to FIG. 2A, a preferred embodiment of the cutting element 12 is shown. The cutting element 12 has a cutting face defined by a substantially planar, circular table 22 of superabrasive material of, for example, PDC, TSP, diamond film or other suitable superabrasive material such as cubic boron nitride. Table 22 is backed by a supporting substrate 28 of, for example, cemented WC, although other materials have been known and used in the art. Table 22 presents a substantially planar major cutting surface portion 18 having a cutting edge 32 at the periphery of a cutting flat 34 disposed at an acute angle to major cutting surface portion 18. As used herein, the term "substantially planar" includes and encompasses not only a perfectly flat surface or table but also concave, convex, ridged, waved or other surfaces or tables which define a two-dimensional cutting surface exhibiting a cutting edge. The substrate 28 has a generally circular cross-section and is attached at its distal end 30 to the bit crown 14 of the drill bit 10 or to a carrier element such as a stud or cylinder, which is itself affixed to drill bit 10. Alternatively, substrate 28 may be brazed by its side surface 31 and distal end 30 into a pocket or socket formed in the bit face.

Figure 2B:
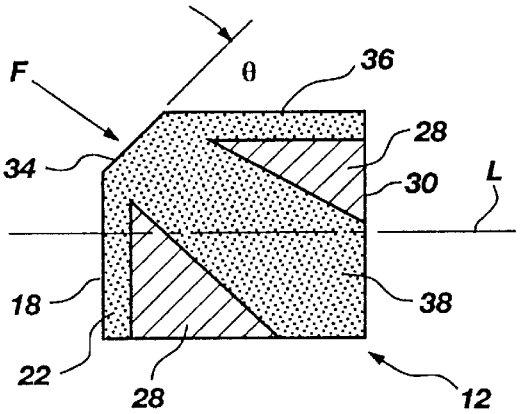
FIG. 2B is a longitudinal cross-sectional view of the cutter shown in FIG. 2A.

As further illustrated in FIG. 2A and better shown in FIG. 2B, the cutting element 12 also may include a diamond side surface or jacket 36 extending around at least a portion of the perimeter of the cutting element 12 from proximate the cutting edge 32 at least partially toward the distal end 30. The jacket 36 helps reduce wear along the cutting element 12 around the cutting edge 32. Moreover, a substantially internal support structure 38 extends from proximate the angled cutting flat 34 to the distal end 30. The support structure 38 is substantially in line with a force vector $F_R$. The force vector $F_R$ is determined by predicting the average resultant force vector that will be experienced by the cutting element 12 during drilling of the drill bit 10 into a subterranean formation under a given weight on bit (WOB) and torque.

Cutting element 12 is rotationally oriented about its longitudinal axis L on the drill bit 10 so that elongated support structure 38 is placed directly under, and in line with, the anticipated cutting loads. The support structure 38, under compressive loading, thus serves to stiffen the superabrasive table 22 against flexure and thereby reduces damaging bending stresses, which tend to place the diamond table under detrimental tensile forces. The angular orientation of the support structure 38 may be at any suitable orientation dictated by the magnitude, location and direction of anticipated loading on the cutting flat 34 and cutting edge 32 of the cutting element 12. It is noted that the direction and magnitude of the force vector $F_R$ applied to cutting element 12 may vary, even for a given WOB and torque, depending on the radial position of the cutting element 12 on the bit profile 13 (FIG. 1), the profile 13 itself, the formation characteristics, pore pressure and other bit- and drilling-related factors.

It is noted that the angle θ at which the plane defined by the cutting flat 34 lies relative to the longitudinal axis L may also affect the angle at which the force vector $F_R$ is translated through the substrate 28. Accordingly, both the cutting flat 34 and the orientation of position of the cutting element relative to the bit face may be used in conjunction to direct the force vector $F_R$ through the substrate 28 in a desired direction, preferably in alignment with the longitudinal direction of support structure 38.

In order to determine the load or force vector F and thus the angle at which the force of drilling will be applied to the cutting element 12, the cutting element may be attached to a test fixture which simulates drilling of the cutting element into a subterranean formation. In such a test, the cutting element 12 is dragged across a flat surface of a test rock specimen at a constant depth of cut, the depth of cut being determined by the amount of force applied to the cutting element 12 transverse to the direction of cut. As the cutting element 12 is dragged across the test specimen, the test apparatus records the magnitude of the horizontal and vertical forces ($F_H$ and $F_V$) transferred through the cutting element 12. By knowing these two forces, $F_H$ and $F_V$, the resultant force vector $F_R$ and thus the angle A, relative to $F_n$, at which the resultant force vector $F_R$ is being applied can be calculated. It is also possible to determine the load or force vector F by other methods known in the art, such as finite element analysis and single point "in situ" testing. During such testing, it was discovered that the angle A through which the resultant force vector $F_R$ is applied to the cutting element 12 remains relatively constant for a range of depths of cut at a constant velocity and at a constant back rake. Accordingly, a support structure 38 which is substantially aligned with the resultant average force vector F would be substantially in line with all force vectors to be experienced during drilling, and thus translate the force vectors $F_R$ through the cutting element 12 and into the bit 10, effectively translating the load from the cutting element 12 to the crown 14 of the bit 10.

As illustrated in FIG. 2B, the cross-section of the support structure 38 is larger nearer the distal end 30 than at the cutting edge 32. Because there is some fluctuation in the load or force vector applied to the cutting element 12 during drilling, either from the depth of cut, cutter velocity, the type of formation and/or the back rake at which the cutting element is set, such a widening cross-section provides for a range of differently-aligned force vectors to be accommodated by the support structure 38 and further adds stability to the support structure by, in effect, buttressing the cutting flat 34 of the cutting element 12 in a manner similar to the "flying buttresses" used to support Gothic cathedrals from the sides.

Preferably, the support structure 38 comprises a sintered polycrystalline diamond compact (PDC) disposed within the substrate 28. Accordingly, the support structure 38 may comprise the same material and thus be formed simultaneously with the superabrasive table 22 and superabrasive surface 36. However, other suitable materials such as a more dense form of tungsten carbide than the rest of the substrate 28, which may otherwise prove to be too brittle to form the entire substrate 28, may be used to form the support structure, such as support structure 42 of the cutting element 40 illustrated in FIGS. 3A and 3B. Alternatively, the table 22, surface 36, and support structure 38 may comprise different types of superabrasive materials, or superabrasive materials of different toughness, density, fracture resistance, and abrasive or erosion-resistance. For example, a diamond film may be used to form table 22, with a PDC or TSP support, and a diamond film surface 36; a cubic boron nitride support may be employed with a PDC table; a TSP support may be employed with a PDC table; and others.

Figure 3A:
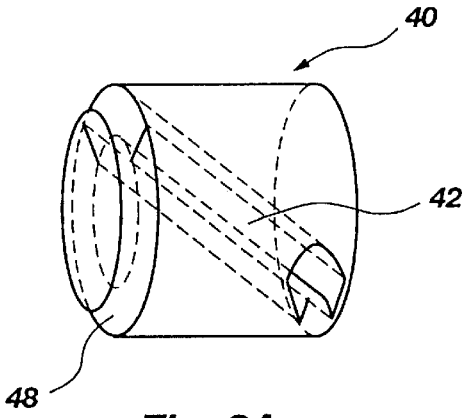
FIG. 3A is a perspective view of a second embodiment of a cutter in accordance with the present invention.
Figure 3B:
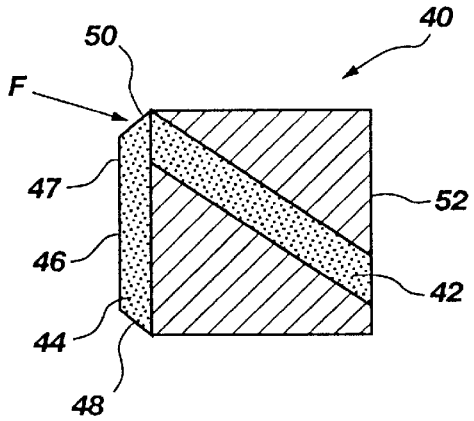
FIG. 3B is a longitudinal cross-sectional view of the cutter shown in FIG. 3A.

Referring to FIGS. 3A and 3B, the cutting element 40 has a substantially circular cross-section and includes a diamond table 44 at its proximal end 46. The diamond table 44 defines a cutting face 47 and includes a chamfer 48 around its perimeter defining a cutting edge 50. Unlike the cutting element 12 illustrated in FIGS. 2A and 2B, the cutting element 40 includes a C-shaped (in transverse cross-section) support structure 42 extending from the diamond table 44 to the distal end 52 of the cutting element 40. In addition, the cross-sectional area and configuration of the support structure 42 is relatively constant from the proximal end 46 to the distal end 52. Such a support structure 42 provides support along a portion of the cutting edge 50 where the cutting element engages the formation during drilling, but requires less material than the support structure 38 of FIGS. 2A and 2B. Where the support structure 42 is comprised of polycrystalline diamond, using less material can significantly reduce the cost of manufacturing such a cutting element 40.

As shown in FIG. 3B, it may be desirable to offset the line of the support structure 42 relative to the force vector F so that the support structure 42 can translate and redirect the force vector F. Such redirection may be desired to reduce the effects of shear between the cutting element and its mounting structure and direct the force vector F to a different location on the bit crown 14.

Figure 4A:
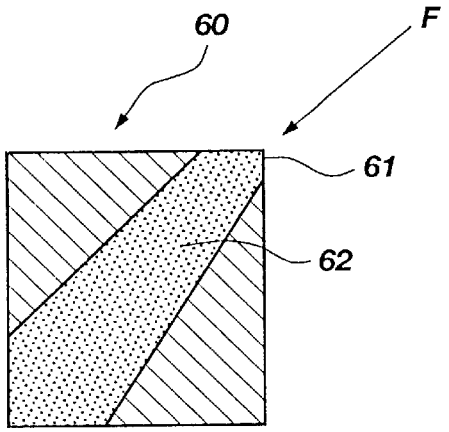
FIG. 4A is a longitudinal cross-sectional view of a third embodiment of a cutter in accordance with the present invention.
Figure 4B:
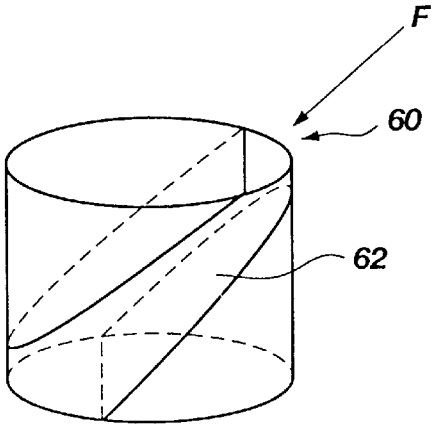
FIG. 4B is a perspective view of the cutter shown in FIG. 4A.

Referring now to FIGS. 4A and 4B, a more simplified version of the cutting element 12 illustrated in FIGS. 2A and 2B is shown. The cutting element 60, while being cylindrical and including a support structure 62 according to the present invention, does not include a conventional diamond or other superabrasive table, such as diamond table 22, or a chamfer. Preferably, the support structure 62 is comprised of polycrystalline diamond and, thus, while providing support for the cutting element 60 also performs the function of cutting the formation during a drilling operation. Accordingly, the cutting element 60, when properly oriented, would contact the formation at its cutting edge 61 and the resultant force vector F would be substantially absorbed by the support structure 62.

Figure 5A:
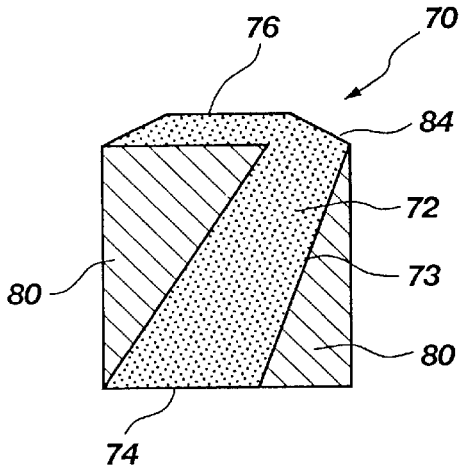
FIG. 5A is a longitudinal cross-sectional view of a fourth embodiment of a cutter in accordance with the present invention.
Figure 5B:
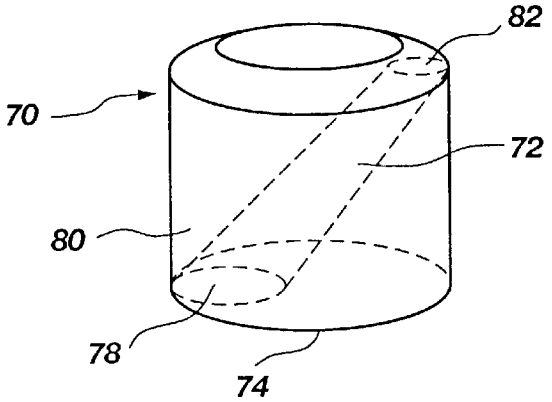
FIG. 5B is a perspective view of the cutter shown in FIG. 5A.

FIGS. 5A and 5B illustrate yet another preferred embodiment according to the present invention showing a cutting element 70 including a support structure 72 having a frustoconical shape and extending in decreasing diameter from the distal end 74 of the cutting element 70 to the diamond table 76. In addition, except for the exposed surface 78 at the distal end 74, the support structure 72 is completely enclosed within the substrate 80. Moreover, a distinct point of support 82 is provided proximate the diamond table 76 nearest the focal point of contact between the cutting edge 84 and the formation being drilled.

Figure 5C:
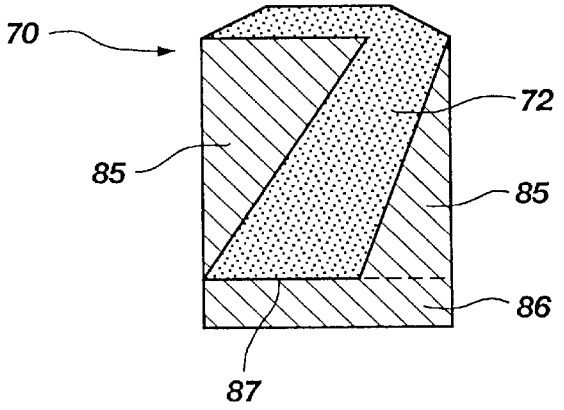
FIG. 5C is a longitudinal cross-sectional view of the cutter shown in FIG. 5A manufactured in accordance with the present invention.

As depicted in FIG. 5C, the cutting element 70 may be formed from a preformed, one-piece substrate blank 85, for the sake of convenience when loading such blanks 85 and polycrystalline material into a cell prior to a high-temperature and high-pressure fabrication process. The blanks 85 may be machined or, more typically, cast from sinterable material such as tungsten carbide. The rear area 86 of blank 85 may then be removed by means known in the art, such as electro-discharge machining (EDM) to achieve the structure of cutting element 70, with elongated support structure 72 terminating at the distal end 74 of substrate 80. Alternatively, rear area 86 may remain in place, covering the distal end 87 of support structure 72.

Upon cooling of cutting element 70 after fabrication, the differences in coefficient of thermal expansion between the material of substrate 80 and the superhard material of table 76 and support structure 72 result in relative shrinkage of the substrate material, placing the superhard material in beneficial compression and lowering potentially harmful tensile stresses in the support structure 72.

The substrate 80 may also be formed by a method of layered-manufacturing, such as the method disclosed in U.S. Pat. No. 5,433,280, assigned to the assignee of the present invention and incorporated herein for all purposes by this reference. The '280 patent discloses a method of fabricating a drill bit body or bit component in a series of sequentially superimposed layers or slices. Thus, a cutting element substrate, such as substrate 80, would be designed as a three-dimensional "solid" model using a computer-aided design (CAD) program, which allows the designer to size, configure and place all internal and external features of the substrate 80, such as (by way of example) internal channel 73 as well as height and shape. With such a method, the substrate 80 could be formed from WC particulate, then sintered, filled with polycrystalline diamond material, and pressed under high temperature to form the support structure 72 and diamond table 76.

Figure 6:
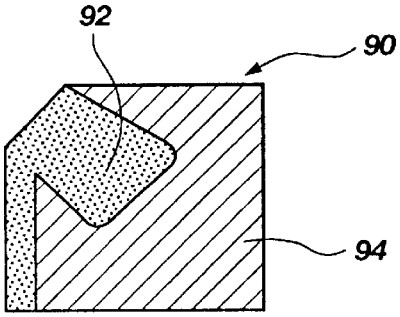
FIG. 6 is a longitudinal cross-sectional view of a fifth embodiment of a cutter in accordance with the present invention.

As further illustrated in FIG. 6, the support structure 92 of the cutting element 90 may not extend completely through the substrate 94 and still provide sufficient support for the load applied to the cutting element 90, distributing same into the substrate 94.

Figure 7B:
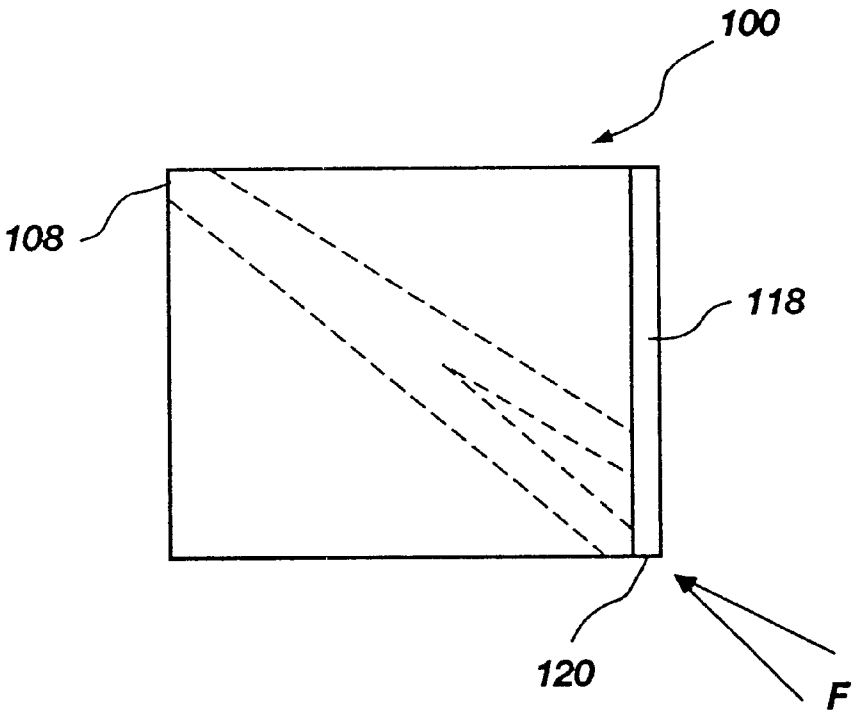
FIG. 7B is a longitudinal cross-sectional view of the cutter shown in FIG. 7A.
Figure 7A:
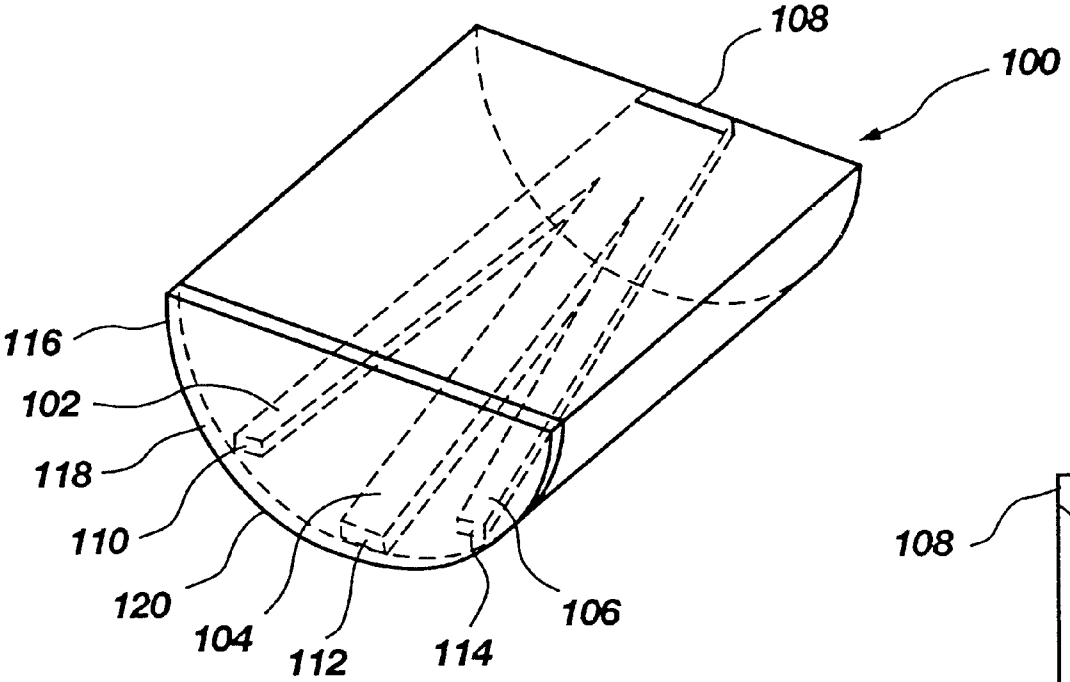
FIG. 7A is a perspective view of a sixth embodiment of a cutter in accordance with the present invention.

FIGS. 7A and 7B illustrate another preferred embodiment of a cutting element 100 according to the present invention. The cutting element 100 has a semicircular cross-section and includes a plurality of support structures 102, 104, and 106 converging proximate the distal end 108. The proximal ends 110, 112, and 114 of the support structures 102, 104, and 106, respectively, are located proximate the radiused or arcuate perimeter 116 of the cutting element 100 and thus support the diamond table 118 at the cutting edge 120. Thus, the converging support structures 102, 104, and 106 direct the force applied to the cutting edge 120 to the center of the distal end 108. Such a semicircular cutter 100 can be formed by manufacturing a single cylindrical form having two cutters 100 in a mirrored, back-to-back relationship and cutting the single cylindrical form in half. As further illustrated in FIG. 7B, the expected range of force vectors F that may be applied to the cutting element 100 during drilling can be supported by the support structures 102, 104, and 106.

Figure 8B:
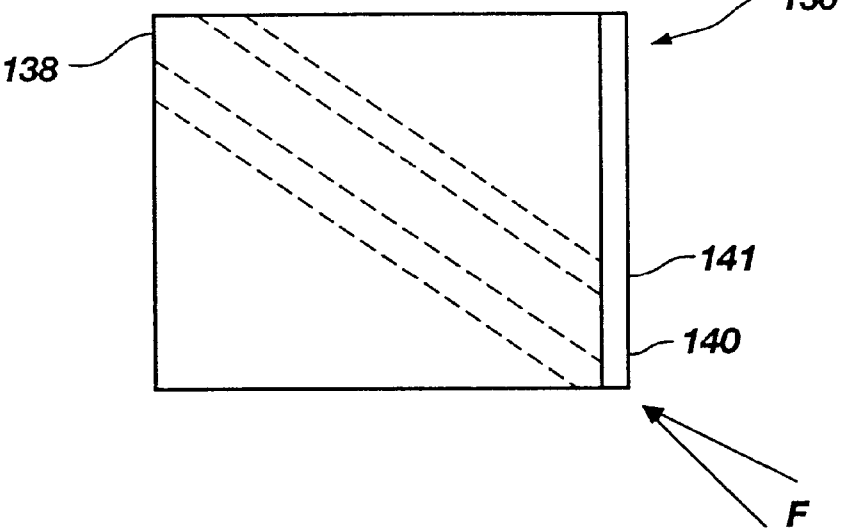
FIG. 8B is a longitudinal cross-sectional view of the cutter shown in FIG. 8A.
Figure 8A:
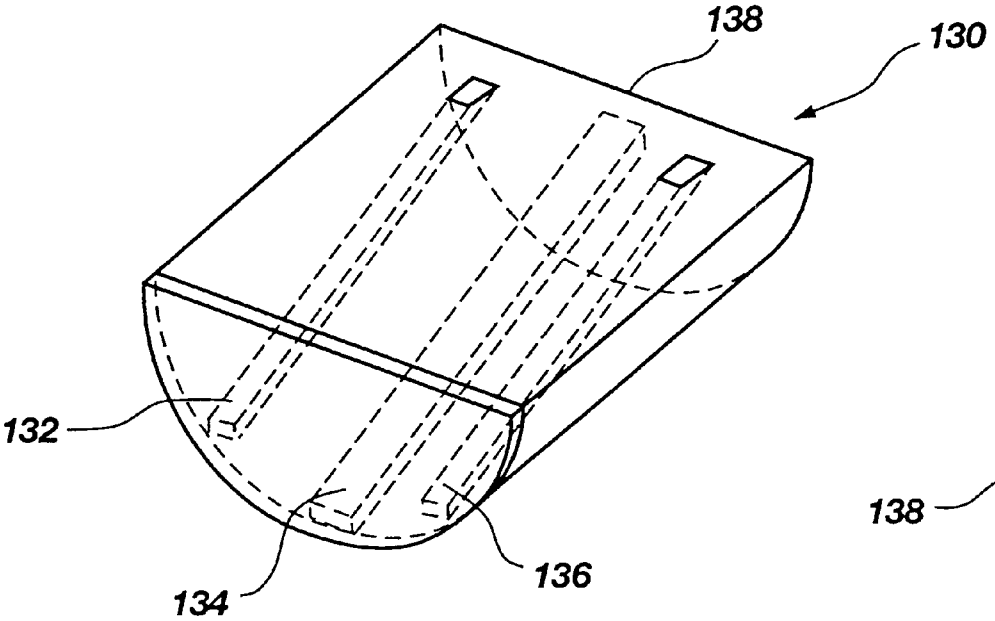
FIG. 8A is a perspective view of a seventh embodiment of a cutter in accordance with the present invention.

The cutting element 130 illustrated in FIGS. 8A and 8B also includes a plurality of support structures 132, 134 and 136 but may be configured in a mutually parallel (shown) or even in a diverging manner toward the distal end 138. In addition, by providing several smaller, discrete support structures 132, 134, and 136, the cutting edge 141 of diamond table 140 can be supported with less material than is required to form other one-piece support structures, such as the support structure 42 illustrated in FIG. 3A.

Figure 9:
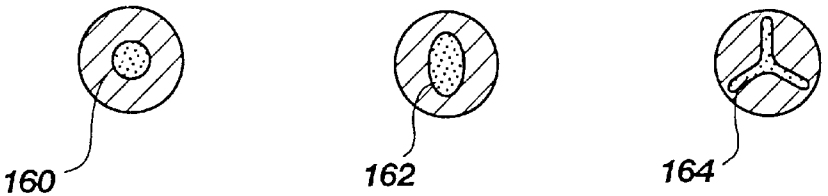
FIG. 9 is a longitudinal cross-sectional view of a third embodiment of a cutter in accordance with the present invention.
Figure 9:
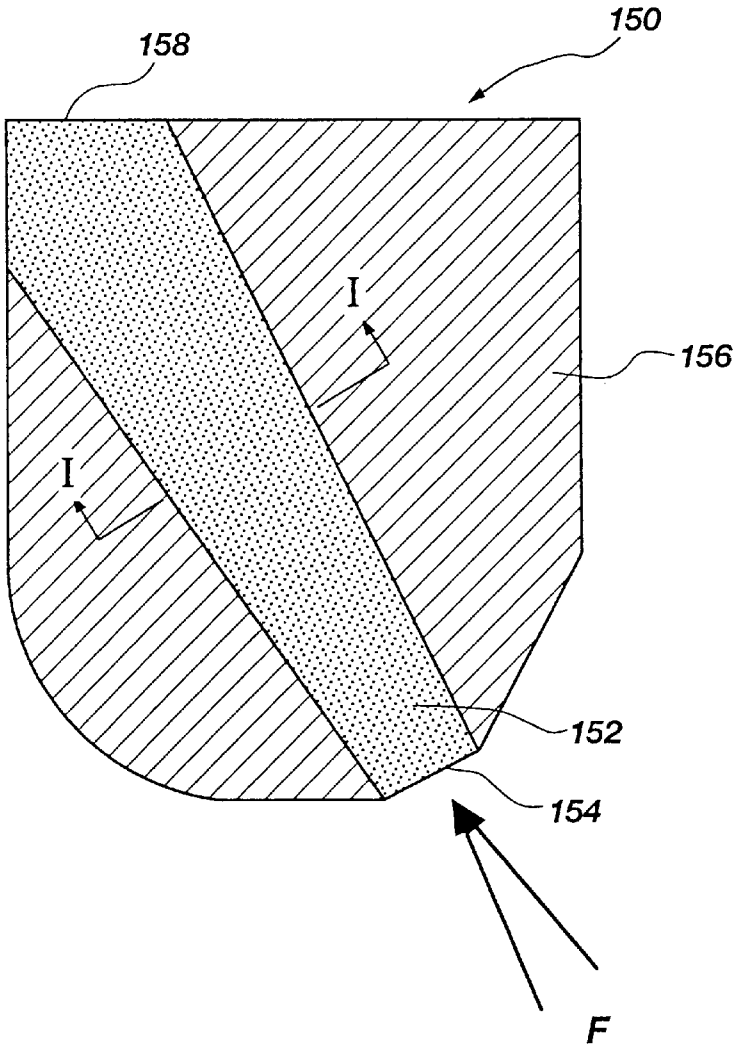

As illustrated in FIG. 9, a support structure 152 has equal utility in various cutters such as a stud cutter 150. Accordingly, the cutting edge 154 subjected to the range of force vectors F is supported by the support structure 152 which translates the range of force vectors F from the cutting edge 154 through the substrate 156 and to the distal end 158 of the cutter 150, which is contained in a socket in the bit body.

Figure 10B:
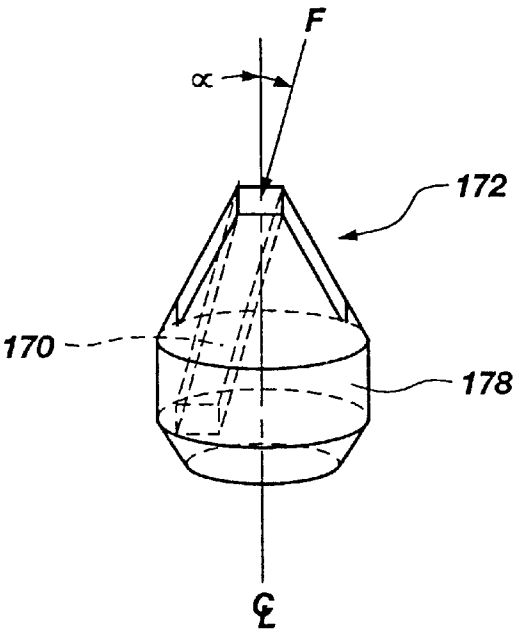
FIG. 10B is a close-up perspective view of a projecting portion of an insert shown in FIG. 10A.
Figure 10A:
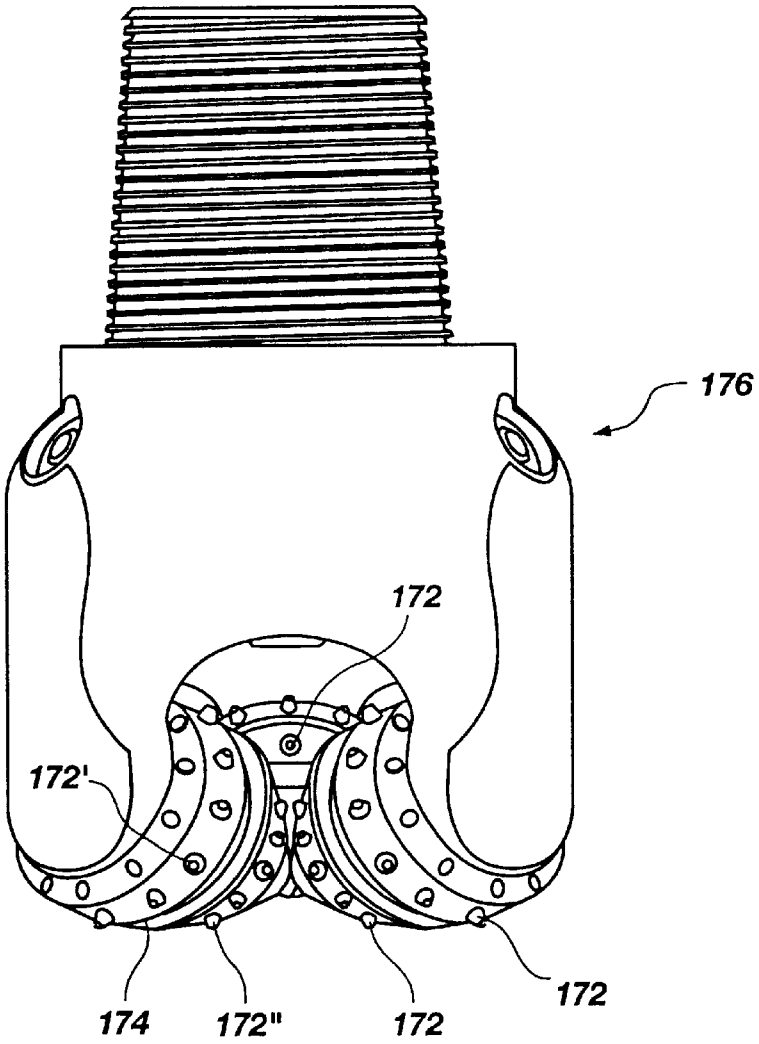
FIG. 10A is a side elevation of a tri-cone bit carrying inserts in accordance with the present invention.

In addition, as illustrated in FIGS. 10A and 10B, a support structure 170 according to the present invention may be provided in each of the inserts 172 on a roller cone 174 of a tri-cone bit 176. As specifically shown in FIG. 10B, the insert 172 comprises a substrate 178 in which a support structure 170 is disposed. The support structure 170 is aligned at an angle $\alpha$, relative to the centerline of the insert 172, to be in line with and thus support a predicted force vector F. It is noted that with the roller cone bit 176, as well as other rotary-type bits such as those herein described, the direction and magnitude of the force applied to insert 172' may be different than the force vector F applied to insert 172". Accordingly, it may be desirable to provide different inserts 172' and 172" to each accommodate the predicted load at its respective location on the roller cone 174 or provide a support structure 170 in the inserts 172' and 172" that can support a range of load vectors.

It is contemplated that various cross-sectional configurations may be employed in the support structure illustrated specifically in FIG. 9 as well as other embodiments herein described are included. For example, as taken along section I—I of FIG. 9, the cross-section of the support structure 152 may be circular 160 (FIG. 9B), oval or ellipsoidal 162 (FIG. 9A), rectangular (see FIGS. 7A–8B) or of a more complex geometric shape 164 (FIG. 9C).

It should be noted that the structures depicted in FIGS. 2A–9 of the drawings, in addition to enhancing strength and stiffness of the cutting element, also promote heat transfer away from the superabrasive table and/or cutting edge of the cutting element. Superhard or superabrasive materials, such as PDC's and TSP's are excellent heat conductors, and far superior to the cemented carbide of a substrate. Thus, support structures provide a conduit for heat transfer away from cutting face and cutting edge, avoiding the heat conductivity limitations imposed by the substrate. As heat transfer problems become more serious as the table and substrate wear, increasing contact area with the formation generates more frictional heat at the same time the cutting element's heat transfer capabilities are reduced. The support structure or structures thus act as conduits for heat transfer to the bit body, which acts as a massive heat sink and which may be more easily cooled with the flow of drilling fluid therethrough.

While certain representative embodiments and details have been shown for purposes of illustrating the invention, it will be apparent to those skilled in the art that various changes in the invention disclosed herein may be made without departing from the scope of the invention, which is defined in the appended claims. For example, various configurations of the support structures may be used, as well as various cross-sectional shapes of the support structures themselves; various shapes and sizes of cutter substrates and superabrasive tables may be utilized; different superabrasive materials may be employed for tables, supports and side surfaces or jackets in the same cutting element; the angles and contours of any beveled or chamfered edges may vary; the superabrasive table may be of square, tombstone, semicircular or other desired shape, as known in the art; and the relative size and shape of any component may be changed. Thus, while the cutting element has been shown as being substantially cylindrical, it is contemplated that other shapes such as cubic, semi-spherical, pyramid or other symmetric and asymmetric shapes may benefit from the invention herein described. Finally, those skilled in the art will appreciate that one or more features of any illustrated embodiment may be combined with one or more features from another to form yet another combination within the scope of the invention as described and claimed herein. Thus, while certain representative embodiments and details have been shown for purposes of illustrating the invention, it will be apparent to those skilled in the art that various changes in the invention disclosed herein may be made without departing from the scope of the invention, which is defined in the appended claims.

What is claimed is:

1. A cutter for use on a rotary bit for earth boring, comprising: a substrate defining a face and a cutting edge at a proximal end thereof and having a distal end and a longitudinal axis; and at least one elongate support structure substantially contained within said substrate and extending substantially diagonally from proximate said cutting edge toward said distal end and crossing said longitudinal axis.

2. The cutter of claim 1, further including a superabrasive table over said face, said at least one elongate support structure extending from proximate said superabrasive table toward said distal end.

3. The cutter of claim 1, wherein said at least one elongate support structure extends substantially an entire longitudinal length of said substrate.

4. The cutter of claim 1, wherein said at least one elongate support structure is polycrystalline and selected from the group comprising diamond and cubic boron nitride.

5. The cutter of claim 1, wherein a cross-section of said cutter transverse to said longitudinal axis is substantially circular.

6. The cutter of claim 1, wherein a cross-section of said cutter transverse to said longitudinal axis is substantially semi-circular.

7. The cutter of claim 1, wherein a cross-section of said at least one elongate support structure is substantially C-shaped.

8. The cutter of claim 1, wherein a cross-section of said at least one elongate support structure is substantially rectangular.

9. The cutter of claim 1, wherein a cross-section of said at least one elongate support structure is substantially round.

10. The cutter of claim 1, wherein said at least one elongate support structure is oriented to direct at least one predicted force vector therethrough.

11. The cutter of claim 10, wherein said at least one predicted force vector is oriented at an angle of approximately between 40° and 70°.

12. The cutter of claim 10, wherein said at least one predicted force vector includes a range of force vectors, said at least one elongate support structure aligned to substantially accommodate said range of force vectors.

13. The cutter of claim 1, wherein said at least one elongate support structure includes a plurality of elongate support structures, each oriented at an angle relative to said longitudinal axis.

14. The cutter of claim 13, wherein said plurality of elongate support structures are each aligned to accommodate at least one predicted force vector within a range of predicted force vectors.

15. The cutter of claim 14, wherein said plurality of elongate support structures are oriented in a mutually parallel relationship.

16. The cutter of claim 1, wherein said cutting edge includes a chamfered portion extending along at least a portion of a perimeter of said substrate.

17. The cutter of claim 1, wherein a cross-section of said at least one elongate support structure is substantially ellipsoidal.

18. The cutter of claim 1, wherein a shape of said at least one elongate support structure is substantially frustoconical.

19. The cutter of claim 1, wherein a cross-sectional area of said at least one elongate support structure increases in size from proximate said face toward said distal end.

20. The cutter of claim 1, wherein said at least one elongate support structure is oriented to be in substantial alignment with at least one predicted force vector.

21. The cutter of claim 20, wherein said at least one predicted force vector includes a range of force vectors, said at least one elongate support structure aligned to substantially accommodate said range of force vectors.

22. A cutter for use on a rotary drag bit for earth boring, comprising:

a substrate defining a face and a cutting edge at a proximal end thereof and having a distal end and a longitudinal axis; and at least one elongate support structure substantially contained within said substrate and extending from proximate said cutting edge toward said distal end and oriented at an angle relative to said longitudinal axis, wherein a cross-sectional area of said at least one elongate support structure increases in size from proximate said face toward said distal end.

23. A cutter for use on a rotary drag bit for earth boring, comprising:

a substrate defining a face and a cutting edge at a proximal end thereof and having a distal end and a longitudinal axis; and at least one elongate support structure substantially contained within said substrate and extending from proximate said cutting edge toward said distal end and oriented at an angle relative to said longitudinal axis, wherein said at least one elongate support structure is oriented to be in substantial alignment with at least one predicted force vector.

24. The cutter of claim 23, wherein said at least one predicted force vector includes a range of force vectors, said at least one elongate support structure aligned to substantially accommodate said range of force vectors.

25. The cutter of claim 23, wherein said at least one predicted force vector is oriented at an angle of approximately between 40° and 70°.

26. The cutter of claim 23, further including a superabrasive table over said face, said at least one elongate support structure extending from proximate said superabrasive table toward said distal end.

27. The cutter of claim 23, wherein said at least one elongate support structure extends substantially an entire longitudinal length of said substrate.

28. The cutter of claim 23, wherein said at least one elongate support structure is polycrystalline and selected from the group comprising diamond and cubic boron nitride.

29. The cutter of claim 23, wherein a cross-section of said cutter transverse to said longitudinal axis is substantially circular or substantially semi-circular.

30. The cutter of claim 23, wherein a cross-section of said at least one elongate support structure is selected from the group comprising substantially ellipsoidal, substantially frustoconical, substantially C-shaped, substantially rectangular, substantially round, and complex geometrically shaped.

31. The cutter of claim 23, wherein said at least one elongate support structure includes a plurality of elongate support structures, each oriented at an angle relative to said longitudinal axis.

32. The cutter of claim 31, wherein said plurality of elongate support structures are each aligned to accommodate said at least one predicted force vector within a range of predicted force vectors.

33. The cutter of claim 32, wherein said plurality of elongate support structures are oriented in a mutually parallel relationship.

34. The cutter of claim 23, wherein said cutting edge includes a chamfered portion extending along at least a portion of a perimeter of said substrate.

35. A rotary drill bit for drilling subterranean formations, comprising:

a bit body having a distal end and a proximal end;

at least one structure for contacting a formation at said distal end of said bit body;

a drill string connecting structure attached to said proximal end of said bit body; and at least one cutting element attached to said at least one cutting structure, said at least one cutting element having a cutting edge and a longitudinal axis and including at least one elongate internal support structure extending diagonally from said cutting edge through at least a portion of said at least one cutting element and crossing said longitudinal axis.

36. The drill bit of claim 35, wherein said at least one cutting element is a stud cutter.

37. The drill bit of claim 36, wherein said at least one structure for contacting a formation is a rolling cone and said at least one cutting element is an insert attached thereto.

38. The drill bit of claim 35, further including a superabrasive table defining said cutting edge, said at least one elongate internal support structure extending from proximate said superabrasive table toward said distal end.

39. The drill bit of claim 35, wherein said at least one elongate internal support structure is polycrystalline and selected from the group comprising diamond and cubic boron nitride.

40. The drill bit of claim 35, wherein a cross-section of said cutter transverse to said longitudinal axis is substantially circular or substantially semi-circular and a cross-section of said at least one elongate support structure is selected from the group comprising substantially circular, substantially C-shaped, substantially rectangular, substantially round, substantially ellipsoidal, and complex geometrically shaped.

41. The drill bit of claim 35, wherein said at least one elongate internal support structure is oriented to be in substantial alignment with at least one predicted force vector.

42. The drill bit of claim 41, wherein said at least one predicted force vector includes a range of force vectors, said at least one elongate internal support structure aligned to substantially accommodate said range of force vectors.

43. The drill bit of claim 41, wherein said at least one predicted force vector is oriented at an angle of approximately between 40° and 70°.

44. The drill bit of claim 35, wherein said at least one elongate internal support structure includes a plurality of elongate support structures, each oriented at an angle relative to said longitudinal axis and each aligned to accommodate at least one predicted force vector within a range of predicted force vectors.

45. The drill bit of claim 44, wherein said plurality of elongate support structures are oriented in a mutually parallel relationship.

46. The drill bit of claim 35, wherein said cutting edge includes a chamfered portion extending along at least a portion of a perimeter of said at least one cutting element.

47. A method of drilling a subterranean formation with a drill bit having at least one cutter thereon, the at least one cutter including a substrate and having an internal support structure formed of a different material than the substrate, the method comprising:

orienting the internal support structure to be in substantial parallel alignment with a drilling force vector; and supporting the drilling force vector incident upon a cutting edge of the at least one cutter along the oriented internal support structure.

* * * * *

UNITED STATES PATENT AND TRADEMARK OFFICE

CERTIFICATE OF CORRECTION

PATENT NO. : 5,967,249
DATED : October 19, 1999
INVENTOR(S) : Trent N. Butcher

It is certified that error appears in the above-identified patent and that said Letters Patent is hereby corrected as shown below:

Title page,
Under "U. S. Patent Documents", delete first reference "592,188 2/1897 Smith et al."; After "5,460,233 10/1995 Meany et al.", on the next line insert -- 5,492,188 2/1996 Smith et al. --;

Column 1,
Line 37, delete "." after "C" and before ")";
Line 50, delete "." after "C" and before ")";

Column 2,
Line 41, after "Cooley" insert -- , --;
Line 46, after "5,787,022" insert -- , --;

Column 5,
Lines 31, before "bit 10" insert -- drill --;
Lines 32, before "bit 10" insert -- drill --;
Lines 35, before "bit 10" insert -- drill --;
Lines 36, before "bit 10" insert -- drill --;

Column 6,
Line 65, before "bit 10" insert -- drill --;
Line 67, before "crown" insert -- bit --;
Line 67, before "bit 10" insert -- drill --;

Column 8,
Line 48, after "73" insert -- (Fig. 5A) --;

Column 9,
Line 3, change "cutter" to -- cutting element --;
Line 5, change "cutters" to -- cutting element --;
Line 25, after "the" (first occurrence) insert -- stud --;
Line 35, change "roller cone" to -- tri-cone --;

UNITED STATES PATENT AND TRADEMARK OFFICE

CERTIFICATE OF CORRECTION

PATENT NO. : 5,967,249
DATED : October 19, 1999
INVENTOR(S) : Trent N. Butcher

It is certified that error appears in the above-identified patent and that said Letters Patent is hereby corrected as shown below:

Column 12,
Line 53, change "claim 36" to -- claim 35 --; and
Line 54, change "rolling" to -- roller --.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*